United States Patent [19]

Jackson

[11] 4,040,360

[45] Aug. 9, 1977

[54] RAILWAY LOCOMOTIVE TRUCK

[75] Inventor: Keith L. Jackson, Granite City, Ill.

[73] Assignee: General Steel Industries, Inc., St. Louis, Mo.

[21] Appl. No.: 658,341

[22] Filed: Feb. 17, 1976

[51] Int. Cl.[2] ..... B61C 3/00; B61F 3/06; B61F 5/14; B61F 5/16

[52] U.S. Cl. ..... 105/136; 105/196; 105/199 R

[58] Field of Search ..... 105/182 R, 133, 136, 105/137, 138, 139, 166, 188, 180, 182, 195, 196, 199 R

[56] References Cited

U.S. PATENT DOCUMENTS

| | | | |
|---|---|---|---|
| 2,741,996 | 4/1956 | Kolesa | 105/196 |
| 3,387,569 | 6/1968 | Lich | 105/196 |
| 3,547,046 | 12/1970 | Lich | 105/182 R |
| 3,693,553 | 9/1972 | Lich | 105/136 |
| 3,796,166 | 3/1974 | Wilmot | 105/182 R |

*Primary Examiner*—Robert J. Spar
*Assistant Examiner*—Howard Beltran
*Attorney, Agent, or Firm*—F. Travers Burgess

[57] ABSTRACT

A six-wheel railway motor truck for swivelly supporting a locomotive body is connected to the same for the effective transmission thereto of draft and braking forces at a level at or near that of the rail whereby the vertical moment arm through which traction forces might act to tip the truck frame and thereby cause load transference from axle to axle is minimized, with corresponding minimization of such load transference. The truck comprises a rigid frame resiliently supported on the three axles, a body support bolster supported on the frame fore and aft of the middle axle for swivel about a point on the longitudinal center line of the truck, the central portion of the bolster above the middle axle being open to provide unobstructed access to the middle axle motor and to provide vertical clearance therefor while maintaining the bolster and overall truck height relatively low. For transmitting longitudinal forces from the truck to the supported body substantially at rail level, the bolster is connected to the vertical body at each side by a pair of longitudinally upwardly and outwardly inclined links arranged so that their axial projections intersect at track level.

5 Claims, 4 Drawing Figures

RAILWAY LOCOMOTIVE TRUCK

BACKGROUND OF THE INVENTION

1. Field of the Invention

The invention relates to railway rolling stock and consists particularly in a three-axle motor truck arranged for draft connection to a vehicle body such that load transference from axle to axle is minimized and so constructed that adequate vertical clearance is provided for the traction motors without substantially increasing the overall height of the truck.

2. The Prior Art

The closest prior art to the present invention is a two-axle truck disclosed in Richard L. Lich U.S. Pat. No. 3,547,046 in which a bolster comprising a transversely extending single beam is swivelly mounted on a single center transom connecting the side members of the rigid truck frame, the opposite ends of the bolster having draft connections to the locomotive underframe comprising upwardly and outwardly longitudinally disposed links arranged such that their axial projections intersect at track level below the bolster. While this arrangement is adequate for a two-axle truck in which the oppositely directed motor to frame reaction connections are at its center transom, if a third intermediate axle were added to the truck below the bolster, the beam-like center transom and bolster would interfere with the middle axle motor and gear box placement or would require elevating the bolster and the body support springs to an undesirably high level.

SUMMARY OF THE INVENTION

A principal objective of the invention is to provide a six-wheel, three-axle railway locomotive truck of the type in which the bolster is swivelly supported on the truck frame and spring supports the locomotive body and is connected to the body at each side by outwardly and upwardly longitudinally inclined traction links, the axes of which converge at rail level beneath the bolster, in which the truck frame and co-operating portions of the bolster are so arranged to provide adequate clearance for the middle axle motor and gear box without any substantial increase in the overall height of the truck.

A more detailed objective of the invention is to provide a pair of spaced transoms fore and aft respectively of the middle axle to form transverse connections between the truck frame side members and to provide separate reaction connections for the middle and one end axle track motors and to provide a bolster similarly open at its center to leave sufficient vertical clearance adjacent the middle axle for the respective motor and gear box.

A further object is to provide an arrangement for transmitting body load from the bolster to the truck frame at points spaced apart transversely and longitudinally of the truck frame and to accommodate swivel of the bolster about a vertical axis relative to the truck frame.

An additional objective is to substantially eliminate any load transference caused by the application of unbalanced motor torques to the truck frame by arranging all three traction motors with their reaction connections to the truck frame in the same direction with respect to their respective axles.

Figure 1:
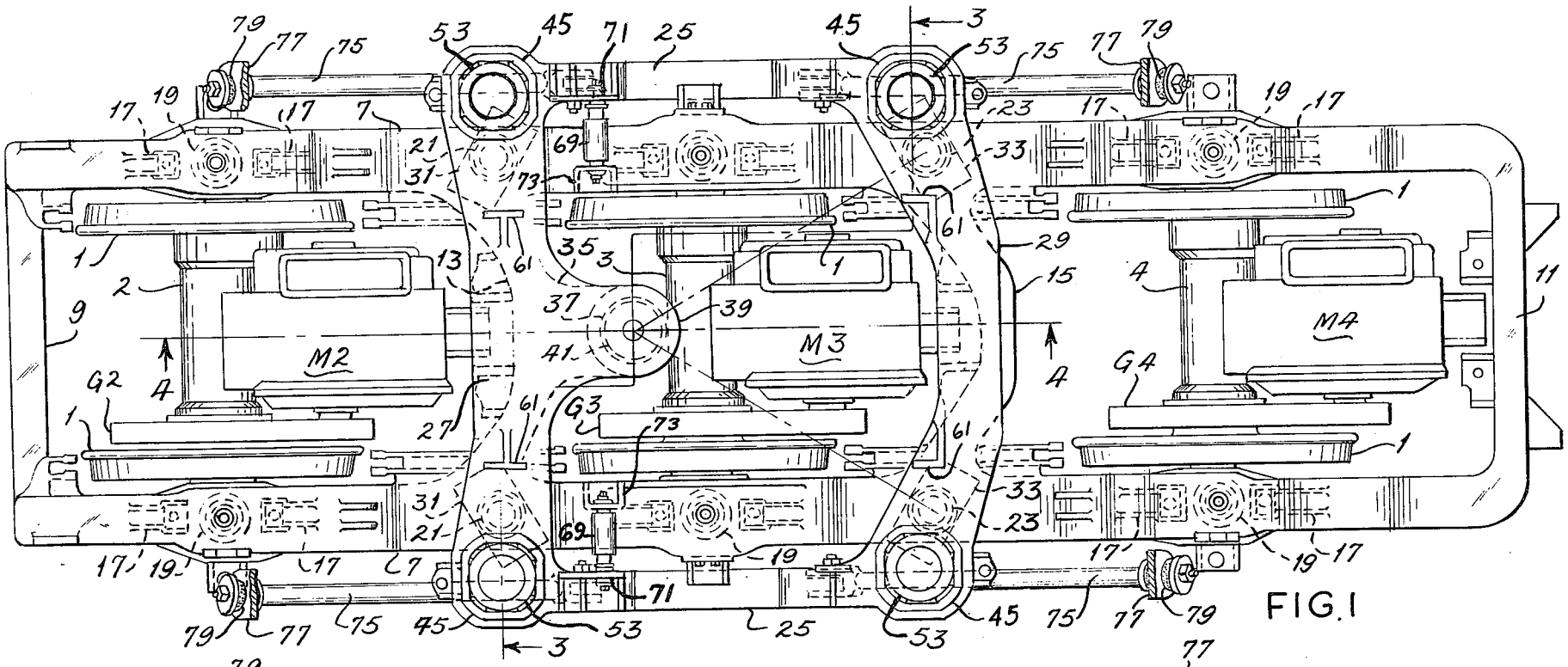
FIG. 1 is a plan view of a truck embodying the invention.
Figure 2:
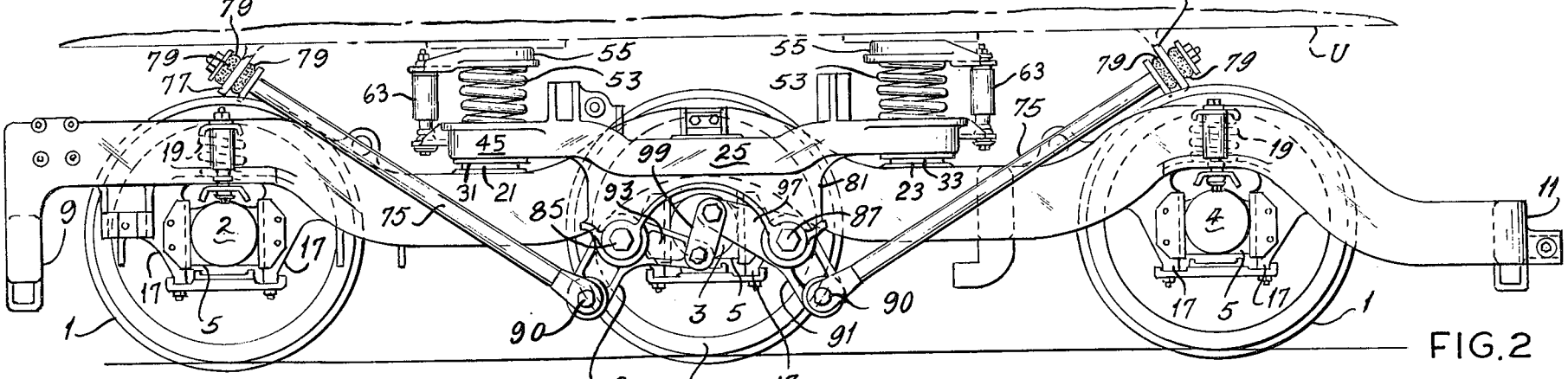
FIG. 2 is a side elevational view of the truck illustrated in FIG. 1 showing adjacent portions of the locomotive underframe.

The numeral 1 indicates railway flanged wheels mounted in gauged pairs of spaced axles 2, 3 and 4, axles 2 and 4 being end axles and axle 3 being a middle axle. At their ends, outboard of wheels 1, axles 2, 3 and 4 are rotatably received within journal boxes 5.

A rigid truck frame, preferably of one piece cast steel construction, comprises transversely spaced longitudinally extending side members 7 positioned transversely outboard of wheels 1 and rigidly connected to each other at their ends by transversely extending end transoms 9 and 11 and, between end axle 2 and middle axle 3 by intermediate transom 13, and between middle axle 3 and end axle 4 by intermediate transom 15.

Frame side members are vertically apertured adjacent journal boxes 5 to form pedestal jaws 17 and journal boxes 5 are vertically slidably received in the respective jaws 17 so as to maintain axles 2, 3 and 4 transverse of the truck frame. Coil spring units 19 are supported on top of journal boxes 5 and resiliently support frame side members 7 to cushion the frame from impacts imparted to the wheels by the track structure. For driving the truck, traction motors M2, M3 and M4 are journaled respectively on axles 2, 3 and 4 with their noses extending in the same direction lengthwise of the truck from their respective axles and having reaction connections respectively to intermediate transoms 13 and 15 and end transom 11.

Gear boxes G2, G3 and G4 drivingly connect the respective motors M2, M3 and M4 to axles 2, 3 and 4.

For supporting the body underframe U on the truck frame and permitting vertical, transverse and swivel movements therebetween, upwardly facing bearing surfaces 21 are formed on the truck frame side members 7 adjacent the inner sections therewith of intermediate transom 13 and similarly upwardly facing bearing surfaces 23 are formed on the side members 7 adjacent the intersections therewith of intermediate transom 15, the portions of side members 7 between pairs of pedestal jaws 17 being depressed to minimize the height of bearing surfaces 21 and 23 above the rail.

A bolster having longitudinally extending side members 25 positioned transversely outboard of truck frame side members 7 and transversely extending end members 27 and 29 spaced apart longitudinally of the truck and, in part at least, respectively overlying intermediate transoms and being formed respectively with downwardly facing sliding bearings 31 and 33 in sliding engagement respectively with upwardly facing bearing surfaces 21 and 23 on truck frame side members 7.

Figure 3:
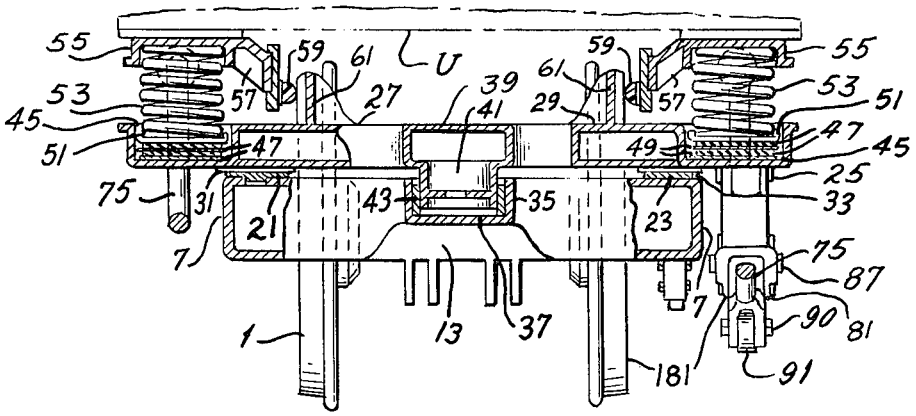
FIG. 3 is a transverse vertical sectional view taken along line 3—3 of FIG. 1.
Figure 4:
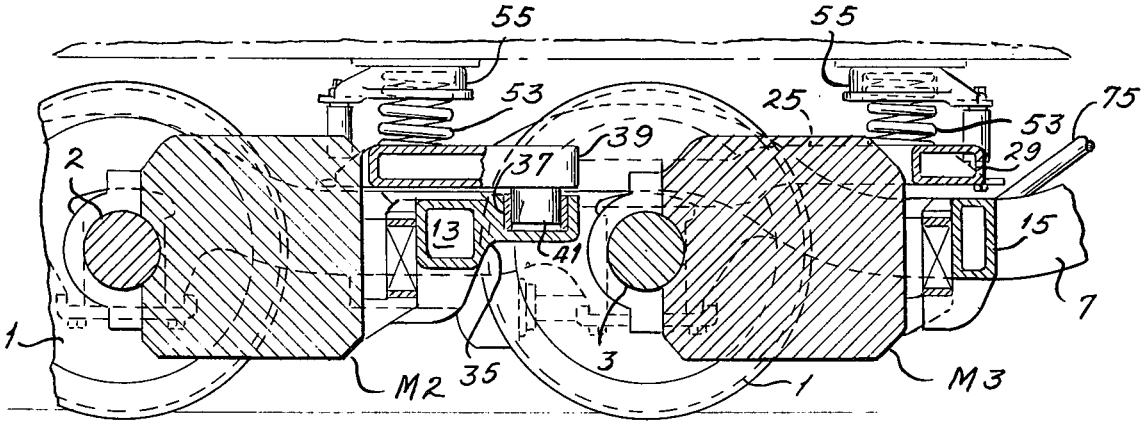
FIG. 4 is a longitudinal vertical sectional view taken along line 4—4 of FIG. 1.

It will be seen from the foregoing and by reference particularly to FIGS. 1, 3 and 4, that the space over the middle axle 3, motor M3 and gear box G3 is open because of the transverse spacing of bolster side members 25 and the longitudinal spacing of bolster end members 27 and 29 from each other, thus providing adequate vertical clearance for the middle axle wheels and for motor M3 and gear box G3 while permitting the bolster height to be at a low level.

For providing a swivel axis for bolster 25, 27, 29 and transmitting longitudinal traction and braking forces from the truck frame to the bolster, intermediate transom 13 is formed with a projection 35 extending longitudinally of the truck toward the middle axle 3 in the space between middle axle wheels 1 unoccupied by motor M3 and gear box G3, and projection 35 is formed with an upwardly open cylindrical bearing pocket 37. Similarly positioned projection 39 on bolster end member 27 is formed with a depending cylindrical boss 41 which is rotatably received in pocket 37, there being a liner 43 of hardened steel in pocket 37 to form a wear resilient bearing for boss 41. The bottom of boss 41 is vertically spaced above the bottom wall of transom projection pocket 37 such that no vertical load is transmitted between boss 41 and transom projection 35, all vertical load of the bolster being carried on cooperating bearing surfaces 21, 31 and 23, 33.

Adjacent the intersections of bolster end members 27 and 29 respectively and bolster side members 25, the latter are formed with upwardly open spring pockets 45. To permit transverse movement of vehicle underframe U relative to the truck, a sandwich device, each comprising a pair of horizontal elastomeric pads 47 bonded by and interleaved with metal plates 49, is seated in each pocket 45 and supports an upwardly open spring seat 51. Each spring seat 51 in turn mounts an upright metallic coil spring 53, which directly supports spring caps 55 which are secured to the bottom of underframe U.

Underframe U is thus capable of vertical movement relative to bolster 25, 27 and 29 through vertical deflection of springs 53 and of lateral movement relative to the bolster through shear deflection in springs 53 and elastomeric pads 47. For limiting lateral movement of the underframe with respect to bolster 25, 27, 29 spring caps 55 are formed with inwardly facing depending lateral stop brackets 57 on which are mounted elastomeric bumpers 59 and bolster end members 29 and 31 are each provided with upstanding lateral stop abutments 61 normally spaced inwardly from elastomeric bumpers 59 and adapted for resilient engagement therewith as maximum transverse movement of the underframe with respect to the truck is reached.

To dampen vertical movements of the underframe U with respect to bolster 25, 27, 29, upright snubbers 63 adjacent bolster spring seat pockets 45 are connected at their lower ends to brackets 65 on the bolster and 67 on springs caps 55.

For transmitting draft forces from the truck at the lowest possible level, preferably rail level, to underframe U and thereby minimizing load transference between the axles, bolster side members 25 are connected to underframe U by outwardly and upwardly directed links 75, the axial projections of which converge at rail level so that the resultant of the forces transmitted axially by both links at each side is at rail level.

The connection of links 75 to underframe U includes brackets 77 on underframe U and resilient pads 79 to accommodate angling of the links with respect to the underframe brackets necessitated by vertical and lateral movements of the underframe relative to the truck bolster.

In order to avoid interference by links 75 with the operation of body support springs 53, bolster side members are formed with transversely spaced depending webs 81 defining between them downwardly open brackets and the connections of the links 75 to the bolster side members 25 each comprises a device consisting of a pair of bell cranks 93, 97 fulcrumed on transverse axes defined by pivot pins 85 and 87 on webs 81 and 83 and having substantially upright arms 89 and 91 pivotally connected at their lower ends respectively at 90 to links 75. Pivotal connections 90 of links 75 to bell crank arms 89 and 91 respectively are constructed to permit universal pivotal movements of links 75 with respect to the respective bell crank arms. The bell cranks have substantially horizontal arms 93 and 97 respectively extending longitudinally of the truck toward each other with their terminals vertically disposed with respect to each other and connected by a short vertical link 99.

It will be evident that as the body moves vertically and laterally with respect to bolster 45 through deflection of springs 53 and shear in elastomeric pads 47, that the bell cranks are pivoted about their respective fulcrums equal distances in opposite rotational directions and will accommodate such movements while maintaining traction links 75 in longitudinal force-transmitting relation between the bolster and underframe U, the effective level of such force-transmission being at the level of convergence of the projections of links 75, i.e., at rail level.

Operation of the truck is as follows: As motors M2, M3 and M4 drive axles 2, 3 and 4 respectively through gear boxes G2, G3 and G4, since their reaction connections to intermediate transoms 13, 15 and end transom 11, respectively, are in the same direction from the respective axles, the motor reactions will tend to raise or lower the entire truck frame simultaneously depending upon direction of operation and will thus produce no axle-to-axle load transference.

Because of the convergence of traction links 75 substantially at rail level, the effective level of longitudinal force transmission from the truck to underframe U will be at the same level, thus eliminating any vertical moment arm about which traction forces might tend to tip the truck frame and thereby transfer load from axle to axle. When body support springs 53 are compressed, left hand traction link 75 causes left hand bell crank 89, 93 to pivot counterclockwise about its fulcrum 85 and right hand traction link 75 causes right hand bell crank 91, 97 to pivot clockwise about its fulcrum 87, both bell cranks pivoting in unison in opposite rotation directions by virtue of their connection to each other by link 99. Thus, irrespective of the extent to which springs 53 are compressed, links 75 are constantly in longitudinal force-transmitting relation between the truck bolster and underframe U. During lateral movements of underframe U with respect to the truck bolster as are permitted by shear deflection in elastomeric pads 47, irrespective of the transverse direction, the bell cranks 89, 93 and 91, 97 will be pivoted respectively in clockwise and counterclockwise directions but will constantly maintain traction links 75 in longitudinal force-transmitting relation between the truck bolster and underframe U.

The details of the construction may be varied substantially without departing from the spirit of the invention and the exclusive use of those modifications as come within the scope of the claims is contemplated.

I claim:

1. In a railway locomotive truck, three wheeled axles spaced apart longitudinally of the truck including first and second end axles and a middle axle therebetween, a rigid truck frame resiliently supported from said axles, said truck frame comprising longitudinally extending side members and first and second transversely extending transom members connecting said side members, respectively, intermediate said first end and said middle axles and said middle and said second end axles, traction motors respectively drivingly connected to each of said axles and having reaction connections to the frame, a bolster comprising longitudinally extending side members and transversely extending first and second end members connecting said side members, said side members being disposed transversely outboard of said truck frame side members and said bolster end members, respectively, overlying at least in part the respective intermediate truck frame transoms, said bolster and said truck frame being substantially free of structural elements in the region defined by said bolster end members and said truck frame side members whereby said bolster end members and the portions of said frame side members therebetween define an opening substantially commensurate with the space defined by said intermediate transom members and said frame side members, opposed horizontal bearing means on both of said bolster end members and said truck frame, said first intermediate truck frame transom and said first bolster end member having cooperating vertical axis swivel bearings centered transversely of the truck, said opposed bearings comprising pairs of transversely spaced upwardly and downwardly facing bearing surfaces on said frame side members and both of said bolster end members, a pair of upright body-support springs seated on each of said bolster end members in substantial transverse alignment with the respective pairs of opposed bearings whereby each of said bolster end members constitutes a beam loaded adjacent its ends and supported near its ends on said truck frame side members, and said bolster side members constitute vertically unloaded spacers and ties between said bolster end members, and a pair of longitudinally upwardly and outwardly inclined links connected at their lower ends to said bolster side members and arranged for connection to the locomotive body such that their axial projections intersect at track level.

2. A railway locomotive truck according to claim 1, wherein the connection of said links to said bolster comprises a pair of bell cranks fulcrummed to said bolster side members on transverse axes spaced apart longitudinally of the truck and having substantially horizontal arms extending toward each other and connected to each other by a substantially vertical link, and other arms extending substantially normal to the axes of the respective inclined links and being pivotally connected thereto.

3. A railway locomotive truck according to claim 1, wherein said middle axle motor reaction connection is to said second transverse transom, and said first intermediate transom and said first bolster end member are formed with central projections in underlying and overlying relation with each other and extending longitudinally of the truck toward said middle axle so as to be positioned wholly on the opposite side of said middle axle from the motor associated therewith, said cooperating vertical axis swivel bearings being formed on the respective transom and bolster projections.

4. A railway locomotive truck according to claim 3 wherein said swivel bearings comprise a pair of mating cylindrical elements, the cylindrical element on said truck frame transom being a female member and that on the bolster end member being a male member.

5. A railway locomotive truck according to claim 1, wherein the reaction connections of said motors to the truck frame are all in the same direction from the respective axles to which the motors are drivingly connected.

* * * * *